US005919054A

United States Patent [19]

Herlach et al.

[11] Patent Number: 5,919,054

[45] Date of Patent: Jul. 6, 1999

[54] LINE CONNECTION

[75] Inventors: Udo Herlach, Benglen; Saverio Sanvido, Glattbrugg, both of Switzerland

[73] Assignee: Oerlikon Contraves AG, Zürich, Switzerland

[21] Appl. No.: 08/917,759

[22] Filed: Aug. 27, 1997

[30] Foreign Application Priority Data

Nov. 25, 1996 [CH] Switzerland ..... 2896/96

[51] Int. Cl.[6] ..... H01R 35/04

[52] U.S. Cl. ..... 439/164; 439/15

[58] Field of Search ..... 439/164, 15

[56] References Cited

U.S. PATENT DOCUMENTS

| | | | |
|---|---|---|---|
| 3,601,623 | 8/1971 | Kirsch . | |
| 5,044,968 | 9/1991 | Bannai et al. | 439/164 |
| 5,066,239 | 11/1991 | Bannai et al. | 439/15 |
| 5,174,515 | 12/1992 | Meier | 439/164 |
| 5,259,775 | 11/1993 | Kubota et al. | 439/164 |
| 5,328,112 | 7/1994 | Obata | 439/15 |

FOREIGN PATENT DOCUMENTS

| | | | |
|---|---|---|---|
| 703931 | 5/1931 | France . | |
| 1984655 | 2/1968 | Germany . | |
| 1945295 | 4/1971 | Germany . | |
| 4-162383 | 6/1992 | Japan | 439/164 |

*Primary Examiner*—Gary F. Paumen
*Attorney, Agent, or Firm*—Browdy & Neimark

[57] ABSTRACT

The line connection (10) connects a first line (14.1) via an intermediate line (12.1) with a second line (16.1) and, functionally parallel therewith, a first branch line (14.2) via an additional intermediate line (12.2) with a second branch line (16.2). The line connection (10) itself comprises two coaxial cylinders (20, 22), which are rotatable in relation to each other, and a planet wheel (24) disposed in the space between the cylinder (20, 22), as well as the intermediate line (12.1) and the additional intermediate line (12.2). Connections (18.1, 18.2) of the first line (14.1) and the first branch line (14.2) to the intermediate line (12.1) and the additional intermediate line (12.2) are disposed on one of the cylinders (20 or 22), and on the other of the cylinders (22 or 20) the connections (19.1, 19.2) of the intermediate line (12.1) and the additional intermediate line (12.2) to the second line (16.1) or the second branch line (16.2). In a zero position all connections (18.1, 18.2, 19.1, 19.2), the intermediate line (12.1) and the additional intermediate line (12.2) as well as the planet wheel (24) are arranged mirror-inverted in relation to a plane of symmetry (S), which is defined by the axes (M) of the cylinder (20, 22) and the axis (N) of the planet wheel (24), wherein the intermediate line (12.1) and the additional intermediate line (12.2), starting at the connections on one cylinder, each encircle one half of the planet wheel in a complementary manner and are then continued to the connections on the other cylinder. With a suitable design, a relative rotation out of the zero position by at least 360° is possible in each direction of rotation.

19 Claims, 6 Drawing Sheets

LINE CONNECTION

FIELD OF THE INVENTION

The invention relates to a line connection for the purpose of connecting a first line with a second line by means of an intermediate line, one end of which is connected by means of a first connection with the first line, and the other end of which is connected by means of a second connection with the second line, which connections can be rotated in respect to each other around a common axis.

BACKGROUND OF THE INVENTION

Line connections of this type are used for connecting two lines with each other, which in the course of their use are moved relative to each other around a common axis; often, but not always, only one of the lines is moved, while the other is fixed in place. An intermediate line is used for connecting the two lines, whose one end is connected with the first line by means of a first connection, and its other end is connected with the second line by means of a second connection. In those cases where only one line which is fixed in place is to be connected with a movable line, one of the connections is fixed in place and the other movable. If the intermediate line is embodied to be flexible, it well be guided in a guiding device, if necessary.

Line connections of this type with a fixed and a movable connector and a comparatively inflexible line arranged in a loop are known, wherein the movement extends, starting in a zero position, in both directions of rotation over an angular range of approximately 90°, for a total of approximately 180°, so that a semicircle can be covered.

In certain areas of employment there is now a requirement of covering the entire circle of 360° in a corresponding manner, wherein even a total angle of more than 360°, for example approximately 400°, should be covered for reasons of practical realization. With a certain structure it would be necessary, on the one hand, to use a very flexible intermediate line; on the other hand, depending on the conception, the intermediate line should also be subjected to stress by pressure and not only tension, and should therefore not have any flexibility, since generally a flexible element can only be subjected to stress tension, but not pressure. These two requirements cannot be reconciled with each other.

It should therefore be noted that line connections of the type mentioned at the outset, by means of which large angles of rotation up to 360° and more can be covered, are not known.

OBJECT AND SUMMARY OF THE INVENTION

It is therefore the object of the invention to propose a line connection of the type mentioned at the outset, which permits a relative rotation of two lines or connections over a full revolution of 360° or a little more.

This object is attained by the characterizing features of claim 1. Preferred embodiments and advantageous further developments of the line connection in accordance with the invention are defined in the dependent claims.

The novel line connection is based on the principle of providing, in place of the lines to be connected and the intermediate line, respectively two lines or intermediate lines, which are arranged parallel functionally, but not geometrically. As will be described further below, this permits a mirror-inverted arrangement of the intermediate line and the additional intermediate line provided in accordance with the invention into two oppositely-extending loops, so to speak, which has the result that the intermediate line and the additional intermediate line are stressed by tension in every movement phase, so that highly flexible lines can be used.

Two coaxial cylinders, namely an inner cylinder and an outer cylinder, which can rotate in respect to each other, are provided as the guide device for the intermediate line and the additional intermediate line. A freely rotatable planet wheel is also a part of the guide device, which in respect to its diameter fits in the circular ring between the two cylinders and whose axis is directed parallel with the axes of the cylinders. The first line is connected with a first connector on the one end of the intermediate line. A first branch line which branches off it is connected with a further connector on the one end of the additional intermediate line. The two connectors mentioned are arranged on one of the cylinders. The second line is connected by means of yet a further connector with the other end of the intermediate line, and the second branch line is connected with a last connector to the other end of the additional intermediate line. The two last mentioned connectors are disposed on a different cylinder than the two first mentioned connectors. As already mentioned, in the zero position of the line connection the intermediate line and the additional intermediate line, as well as the planet wheel, are arranged symmetrically in relation to a plane of symmetry defined by the axes of the cylinders and the axis of the planet wheel, which is in the zero position. The intermediate line runs from its first connector on one of the cylinders along this cylinder as far the planet wheel, turns around it over 180° and continues along the other cylinder until reaching the connector of that cylinder correspondingly, the additional intermediate line runs from the connector of one cylinder to the planet wheel, circles half of it, complementary with the intermediate line, and continues along the other cylinder as far as the connector disposed on this cylinder.

The above described line connection in accordance with the invention is advantageous not only because of the chance of using highly flexible cables and thus to also cover large angles up to 360° and greater, but the symmetrical arrangement is also advantageous in view of the torque, because no restoring forces are generated and the friction of the entire arrangement is minimal. A further advantage of the line connection in accordance with the invention, which in certain circumstances is important, lies in that it protrudes neither toward the interior nor the exterior past a hollow cylinder corresponding to the space delimited by the inner and the outer cylinder, so that other components can be housed, particularly in the center, and preferably those which have a coaxial relationship with the relative movement of the two cylinders.

Even though it is possible to rotate both cylinders, often a combination of a fixed and a rotatable cylinder is preferred.

From a structural viewpoint it is practical in many cases to move the outer cylinder, especially because of the space for the moved lines, although this entails the disadvantage of having to accelerate or decelerate a larger mass.

The exact locations of the connectors are defined by the desired total angle of rotation, as well as of course the ratio of the diameters of the two cylinder. To achieve an angle of rotation of approximately 200° it is possible, if a diameter ratio in the approximate range of 1:2 is selected, to arrange the connectors on one of the cylinders approximately diametrically in the zero position of the connectors, while the connectors on the other cylinder can coincide in the plane of symmetry.

To prevent entanglement between the intermediate line and the additional intermediate line axially next to it, it is advantageous if the guide faces, i.e. the inner circumferential face of the outer cylinder, the outer circumferential face of the inner cylinder and the outer circumferential face of the planet wheel, have guide grooves or guide ribs extending in the circumferential direction. Corresponding cylinder bottoms or cylinder covers can also perform guide functions.

Although the novel line connection is also very well suited for small angles of rotation, it is particularly advantageous if a relative total angle of more than 360°, i.e. approximately 400°, needs to be covered, so that a rotation out of the zero position of respectively approximately 200° results in the extreme positions.

For the fixation in the extreme positions it is advantageous if appropriate detents are provided on the cylinders.

A particular problem in connection with such detents arises if the total angle of rotation exceeds 360°. In this case a detent element can be provided on one of the cylinders. Two fixed detents are disposed on the other cylinder and the angular distance of these fixed detents equals the total angle of rotation less 360°. A detent lever, which is freely pivotable between the fixed detents, is disposed centered between these fixed detents. The fixed detents are used for positioning the detent lever, which cooperates with the detent plate in the extreme positions, depending on the extreme position. In the one extreme position the detent lever is located between the one fixed detent and the one face of the detent element, in the other extreme position the detent lever is located between the other fixed detent and the opposite face of the detent element. This detent element can also be embodied in the manner of a lever for changing the maximal angle of rotation to be covered and, if needed, for adjustment.

The line connections in accordance with the invention are suitable for connecting lines of all types, for example fluid lines, glass fiber lines and electric cables, particularly ribbon cables of the flex print type.

The various aspects of the invention will be extensively represented below by means of a preferred embodiment, making reference to the drawings.

DETAILED DESCRIPTION OF THE PREFERRED EMBODIMENT

Figure 1:
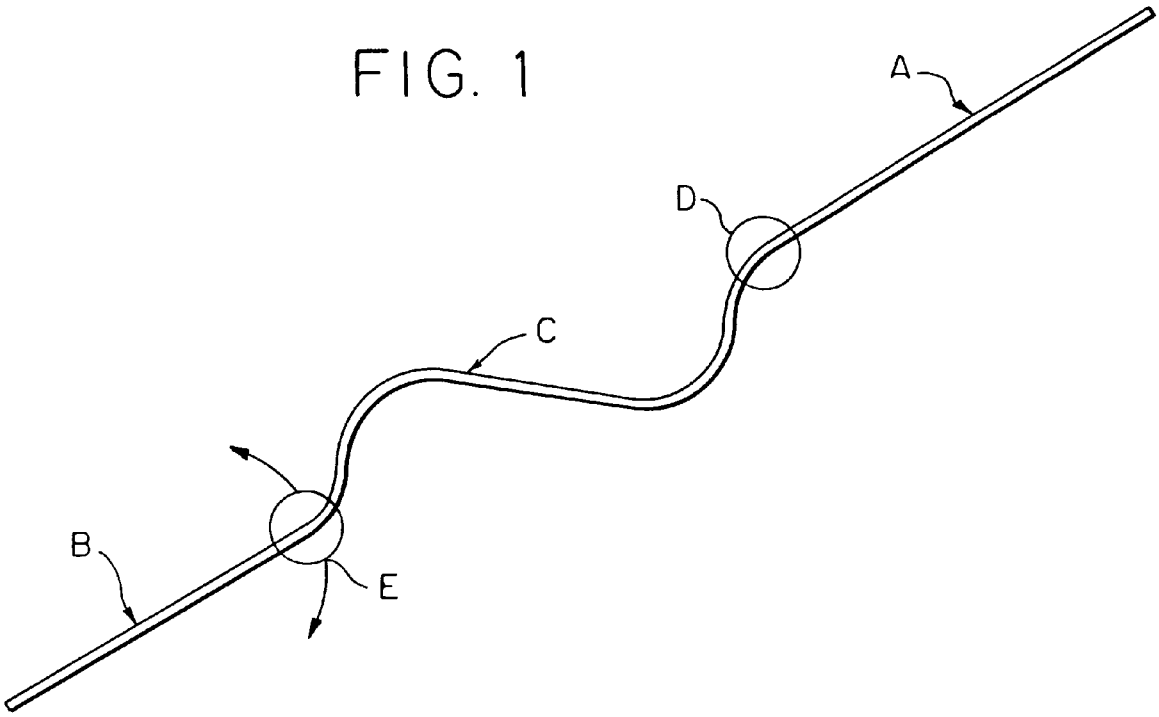
FIG. 1 represents a line connection in accordance with the prior art for explaining the problem solved by the invention, in a greatly simplified schematic view.

FIG. 1 shows an embodiment of a line connection in accordance with the prior art. The line connection is used for connecting the line A with a further line B, for which purpose an intermediate line C is used. The intermediate line C is connected with the line A at a connector D, and at a connector E with the line B. Assuming that the line A and the connector D are fixed and the line B and the connector E are movable, the connector E must move over the required angle of rotation or on a corresponding circle line from the one extreme position into the other extreme position, as indicated in FIG. 1 by arrows emanating from E. In the course of this movement the connector E and therefore the end of the intermediate line C connected there are guided by means of a guide device. In cases where the angle of rotation must lie in the range around 360° or more, the connector D, for example, which is considered to be movable, must theoretically rotate out of its zero position in both directions of rotation by 180° or, taking into consideration structural actualities, by more than 180°, which corresponds to a total angle of rotation of more than 360°. FIG. 1 makes it clear that, as described above, the known line connections are suitable for a range of altogether approximately 50°, but not for larger angles of rotation.

Figure 2:
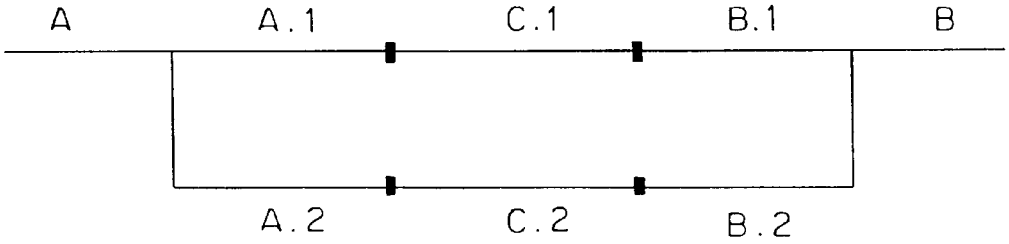
FIG. 2 shows a schematic representation of the line guidance in connection with a line connection in accordance with the invention.

The basic concept of the invention is now to be seen in that, as in the prior art, the lines A and B are connected by an intermediate line C wherein, however, as shown in a purely schematic form in FIG. 2, the line A is split into a line A.1 and a branch line A.2, and the line B into a line B.1 and a branch line B.2. In this case the lines A.1 and B.1 are connected by an intermediate line C.1, while the branch lines A.2 and B.2 are connected by an additional intermediate line C.2. As will be described further below, the intermediate line C.1 and the additional intermediate line C.2 are symmetrically arranged, in particular in view of the required movements. The line train A.1, C.1, B.1 on the one hand, and the line train A.2, C.2, B.2 on the other form functionally, but not geometrically parallel lines.

Figure 3:
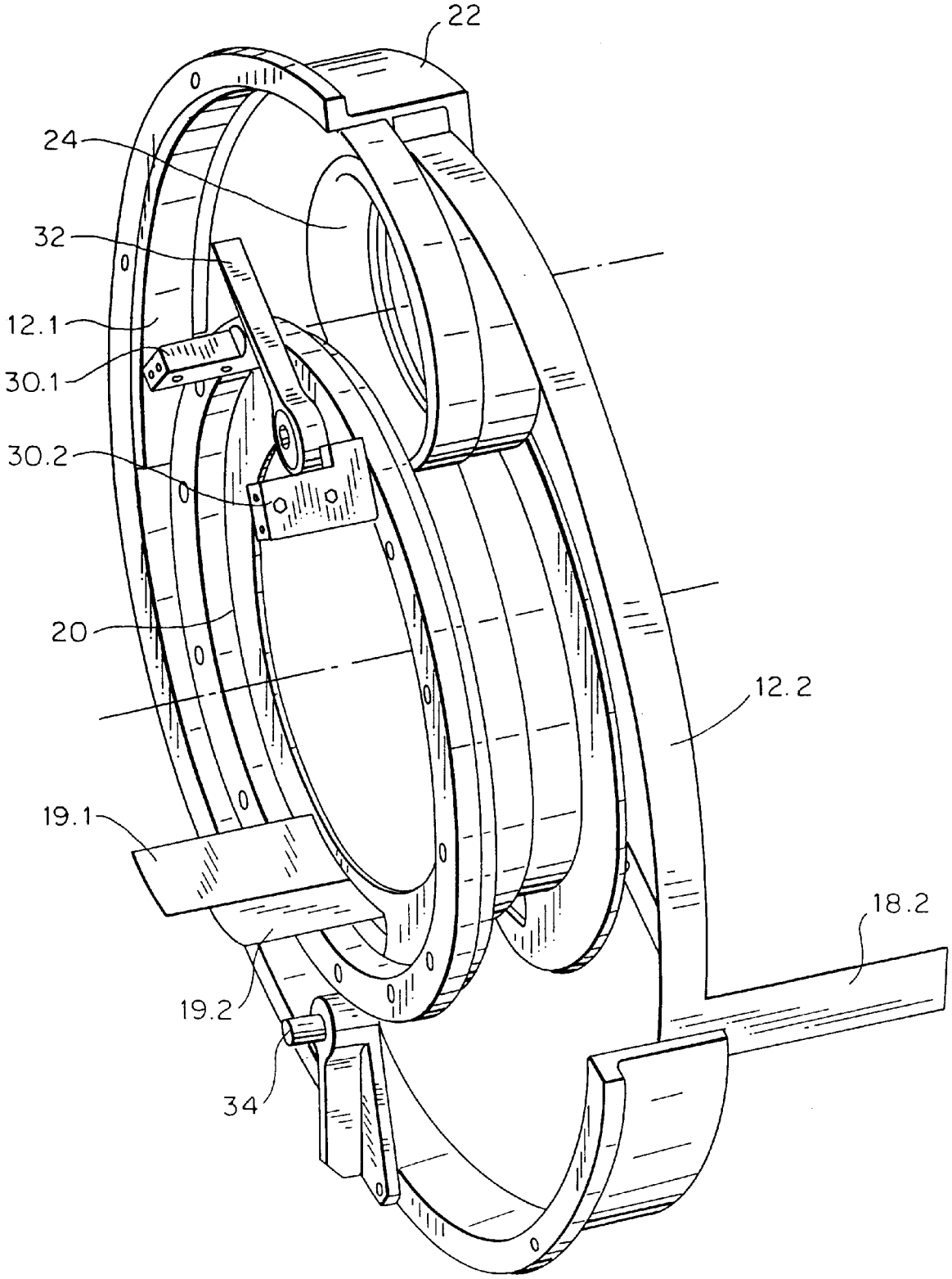
FIG. 3 represents a line connection in accordance with the invention as a simplified diagram, wherein the movable elements are in their zero positions.
Figure 4:
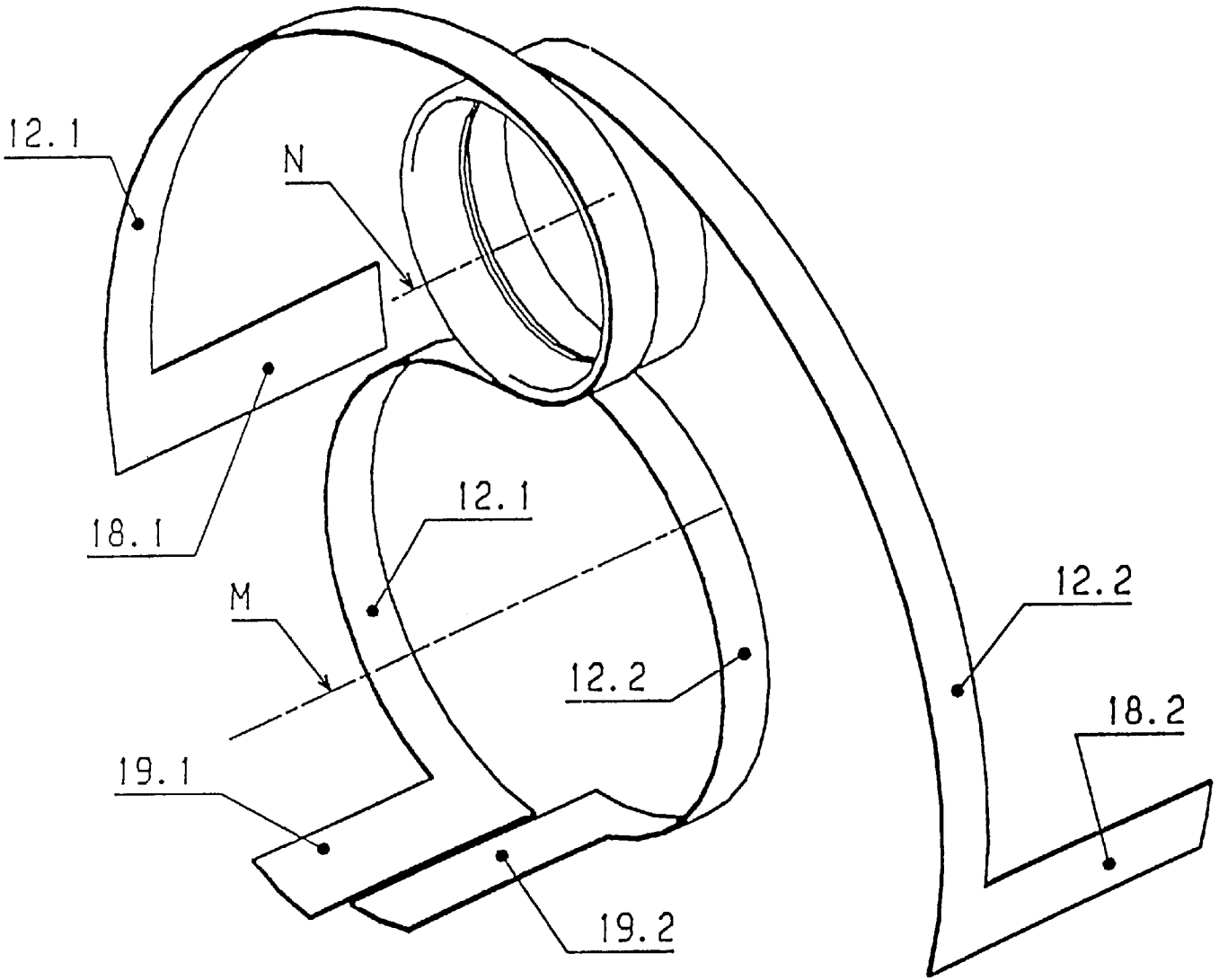
FIG. 4 represents the intermediate line and the additional intermediate line in the same position and representation as in FIG. 3.

The line connection 10 in accordance with the invention represented in FIGS. 3 to 5 is used for connecting electrical lines. It has an intermediate line 12.1 and an additional intermediate line 12.2, both in the form of flex prints. An inner cylinder 20 and an outer cylinder 22, which have a common axis M around which they can be rotated in relation to each other, are provided as guide devices for the intermediate line 12.1 and the additional intermediate line 12.2, which will be described in more detail below. In the exemplary embodiment shown, the inner cylinder 20 is fixed, while the outer cylinder 22 is rotatable. A freely movable planet wheel 24, which is also to be considered as part of the guide device, is disposed between the cylinders 20 and 22, and its diameter essentially corresponds to the radius difference between the two cylinders 20, 22, and its axis N is oriented parallel with the axis M.

The intermediate line 12.1 connects a first line 14.1 with a second line 16.1, and the additional intermediate line 12.2 connects a first branch line 14.2 with a second branch line 16.2. In this case the one end of the intermediate line 12.1 is connected with the first line 16.1 at a connection 18.1, and the other end of the intermediate line 12.1 is connected with the second line 16.1 at a connection 19.1. Correspondingly the one end of the additional intermediate line 12.2 is connected with a first branch line 14.2 at a connection 18.2, and the other end of the additional intermediate line 12.2 is connected with the second branch line 16.2 at a connection 19.2. The connections 18.1 and 18.2 are located on the outer cylinder 22, which is movable in the instant exemplary embodiment, and the connections 19.1 and 19.2 on the inner cylinder 20, fixed in the instant exemplary embodiment. It is obvious that in the present configuration the connections 18.1 and 19.1, and therefore also the second line 16.1 and the second branch line 16.2, could also be combined.

Figure 5A:
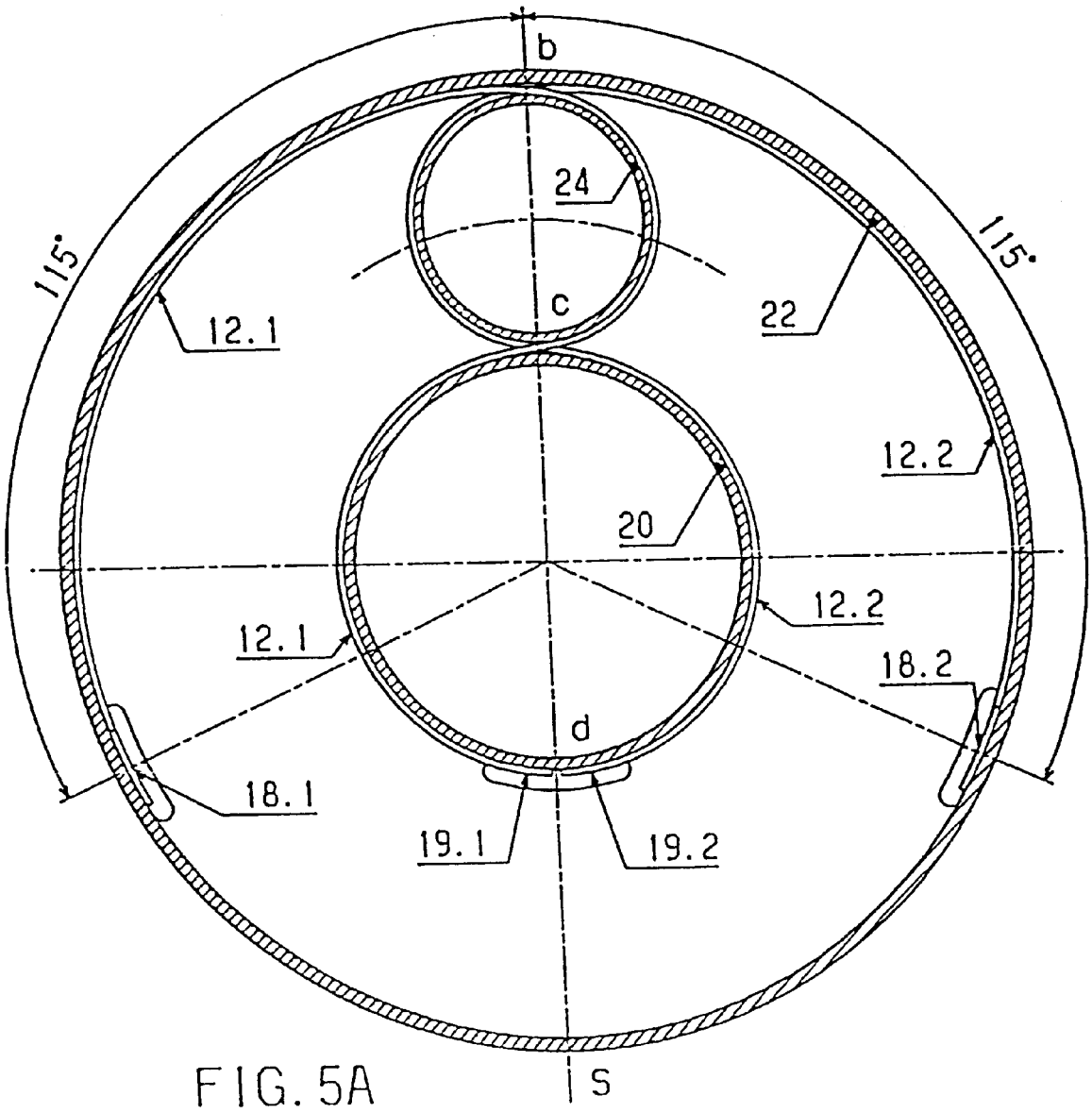
FIG. 5A represents a line connection in accordance with the invention in a simplified schematic view, wherein the movable elements are in the zero position.
Figure 5B:
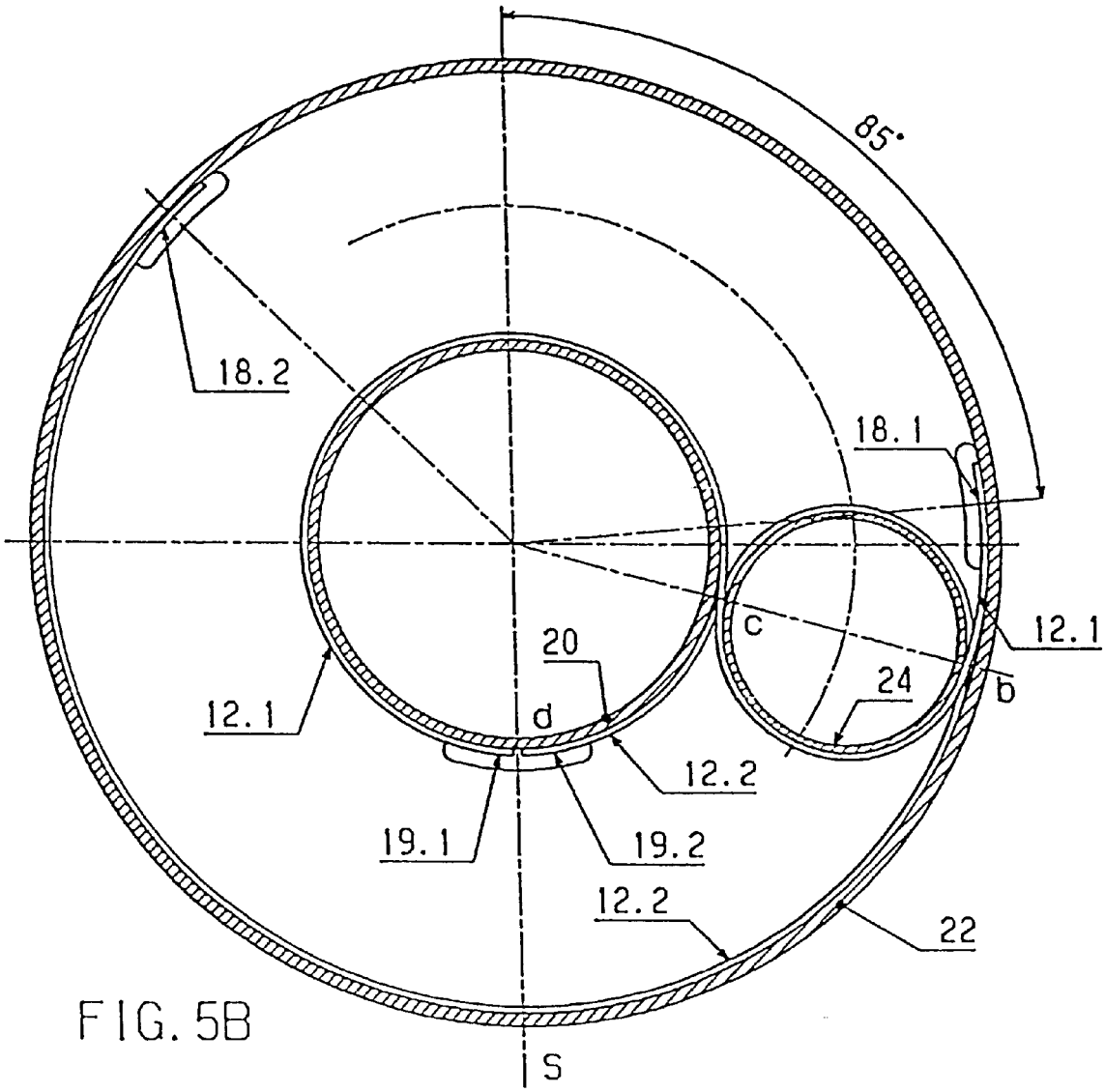
FIG. 5B represents the line connection shown in FIG. 5A, wherein the movable elements are in the one extreme position.
Figure 5C:
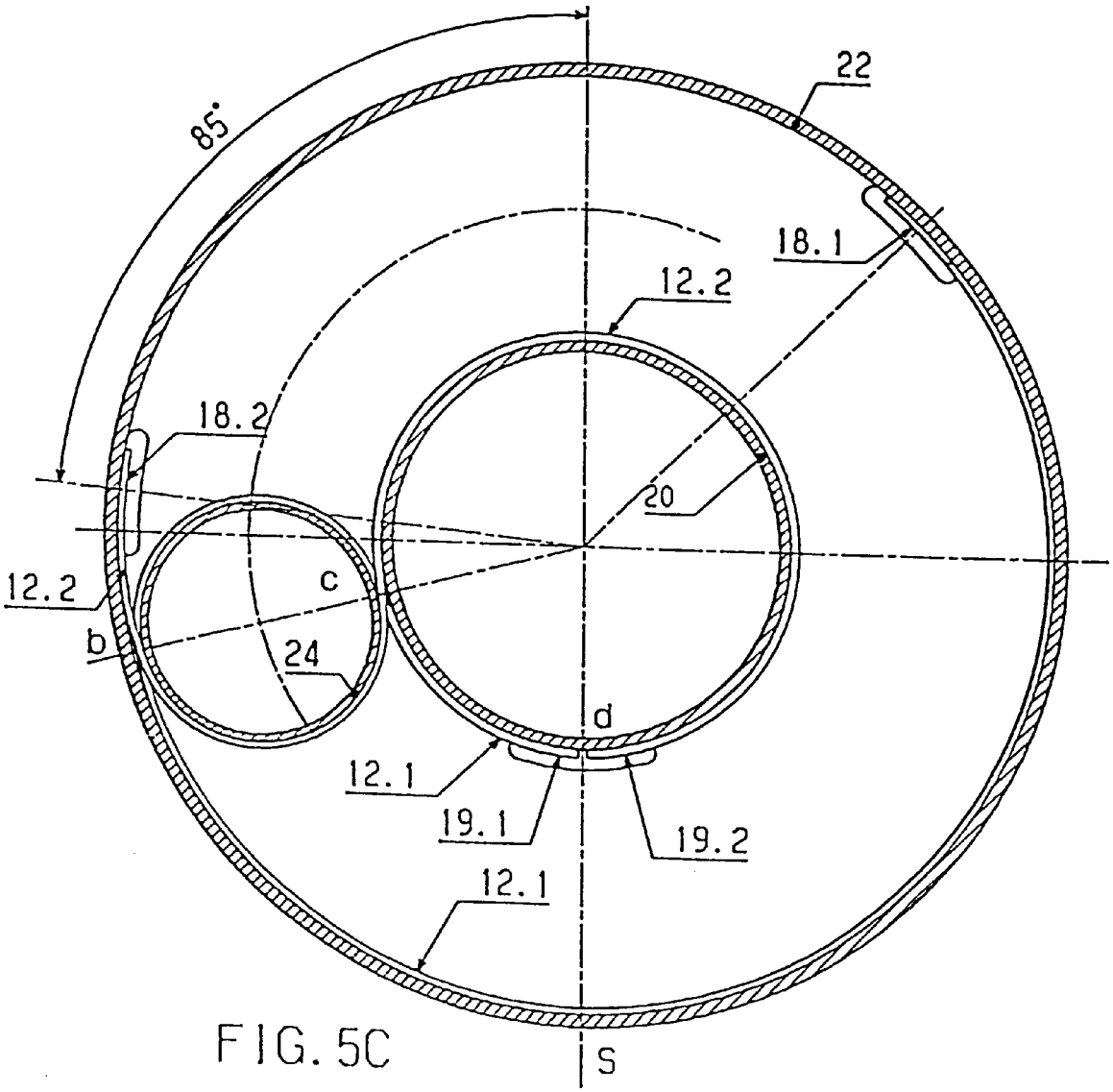
FIG. 5C represents the line connection shown in FIGS. 5A and 5B, wherein the movable elements are in the other extreme position.

As can best be seen from FIGS. 4 and 5A, the intermediate line 12.1, the additional intermediate line 12.2 and the planet wheel 24 are symmetrically arranged in the zero position of the line connection, namely in relation to one plane of symmetry S, which is defined by the axis M of the cylinders 20, 22 and the axis N of the planet wheel 24, which is in the zero position and which is drawn in FIGS. 5A to 5C, where it is represented by a vertical straight line.

The intermediate line 12.1 extends from the connection 18.1 along the inner wall of the outer cylinder 22 up to the planet wheel 24, turns around it along its one half and continues along the outer wall of the inner cylinder 20 as far as the connection 19.1. The additional intermediate line 12.2 runs from the connection 18.2, around the other half of the planet wheel 24, and to the connection 19.2.

It should also be noted that, depending on the flexibility of the line material, and particularly if the axes M and N are not vertically oriented, without additional design measures the intermediate line and the additional intermediate line need not follow the inner wall of the outer cylinder 22 from the starting point on the planet wheel 24 to the connection 18.1 or 18.2, but instead are disposed directly, but in a wavy arrangement.

The function of the elements so far described will be explained, making reference to FIGS. 5A to 5C, wherein the diameters of the cylinders 20, 22 and the lengths of the intermediate line 12.1 and the additional intermediate line 12.2 are not represented exactly to scale.

FIG. 5A shows the movable elements of the line connection 10 in its zero position, while FIG. 5B approximately represents the one extreme position, and FIG. 5C approximately the other extreme position of the movable elements of the line connection 10.

It can be seen from FIG. 5B, that in comparison with FIG. 5A the outer cylinder 22 has been rotated counterclockwise by almost 180° into a position, wherein the connections 18.1 and 18.2 disposed on the outer cylinder 22 were of course also rotated along. The inner fixed cylinder 20 and the connections 19.1 and 19.2 disposed on it are permanently in the position represented in FIG. 5A. Because of the movement of the connection 18.1, the planet wheel 24 has turned by almost 270° around the axis M in the area of its first extreme position, or has rolled between the inner cylinder 20 and the outer cylinder 22. The portion of the intermediate line 12.1 extending along the inner cylinder 20 has been reduced, wherein simultaneously the portion of the intermediate line 12.1 extending on the outer cylinder 22 has been increased by the same length. Conversely, the portion of the additional intermediate line 12.2 extending on the inner cylinder 20 has been increased and the portion of the additional intermediate line 12.2 has been correspondingly reduced. In the course of these position changes, the intermediate line 12.1 was, so to speak, pulled by the connection 18.1 and was guided by the inner cylinder 20, the outer cylinder 22 and by the planet wheel 24, which was moved by this. Simultaneously, the additional intermediate line 12.2 was pulled, so to speak, by the planet wheel 24 and in the process was also guided by the inner cylinder 20 and the outer cylinder 22. In contrast to the zero position, there is no symmetry of the movable parts of the line connection 10 in all other positions.

Continuing the described rotation of the outer cylinder 22 into the position represented in FIG. 5B, it is further rotated into its one end position. This is followed by turning back into the zero position and immediate further turning into the position represented in FIG. 5C, in which the movable parts are almost in their second extreme position. In the process there was a total rotation in a clockwise direction by more than 360°. Following this there is again a rotation by more than 360°, but in a counterclockwise direction. All these rotations are analogously performed the same as the rotation explained in detail with reference to FIGS. 5A and 5B.

Two fixed detents 30.1, 30.2 are mounted on the inner cylinder 20 for fixing the extreme positions, and centered between them a freely movable detent lever 32, which can be blocked by a blocking device, if required. The mutual angular distance of the fixed detents is approximately 40°, if it is assumed that the total angle of rotation is to be 400°. A detent element 34 is fastened on the outer cylinder 22. In the one extreme position the detent lever 32 is located between the one fixed detent 30.1 and the one face of the detent element 34, and in the other extreme position the detent lever 32 is located between the other fixed detent 30.2 and the other face of the detent element 34.

FIG. 3 in particular shows clearly that the entire line connection can be arranged in a hollow-cylindrical space, which is delimited by the two cylinders 20, 22. Thus the central space in the inner cylinder 20 and the vicinity outside the outer cylinder 22 remain free for other components.

The line connection 10 described above represents only one embodiment of the line connections in accordance with the invention, and a multitude of further embodiments are possible within the framework of the above specification and the drawings, as well as the claims.

What is claimed is:

1. A line connection (10) for the purpose of connecting a first line (14.1) with a second line (16.1) by means of an intermediate line (12.1), one end of which is connected by means of a first connection (18.1) with the first line (14.1), and the other end of which is connected by means of a second connection (19.1) with the second line (16.1), which connections (18.1, 19.1) can be rotated in respect to each other around a common axis (M), characterized in that an additional intermediate line (12.2) is disposed, an outer cylinder (22) and an inner cylinder (20), which are rotatably disposed around the same axis (M) in relation to each other, as well as a planet wheel (24), freely rotatable between the cylinder (20, 22), whose axis (N) is oriented parallel with the axis (M), are provided as the guide device for the intermediate line (12.1) and the additional intermediate line (12.2), wherein the first connection (18.1) and a third connection (18.2), which connects a first branch line (14.2), which is branched off the first line (14.1), with the one end of the additional intermediate line (12.2), are disposed on one of the cylinders (20), and the second connection (19.1) and a fourth connection (19.2), which connects a second branch line (16.2), which is branched of the second line (16.1), with the other end of the additional intermediate line (12.2), are disposed on the other of the cylinders (22), so that in a zero position, out of which the cylinders (20, 22) can be rotated in relation to each other in both directions of rotation, the connection (18.1), the connection (19.1) as well as the intermediate line (12.1) on the one hand, and the connection (18.2), the connection (19.2) as well as the additional intermediate line (12.2) on the other hand are arranged symmetrically in respect to a plane of symmetry (S), which is defined by the axis (M) of the cylinders (20, 22) and by the axis (N) of the planet wheel (24), which is in the zero position, wherein in the zero position the intermediate line (12.1) and the additional intermediate line (12.2) run, located axially next to each other, from their connections (18.1 and 18.2) disposed on the one cylinder (22) along this cylinder (22) to the planet wheel (24), circle respectively one half of it in a complementary manner and are guided along the other cylinder (20) to their connections (19.1 and 19.2) disposed on the latter cylinder (20).

2. The line connection (10) in accordance with claim 1, characterized in that it is disposed, preferably including the lines (14.1, 16.1) and the branch lines (14.2, 16.2), in the hollow cylinder delimited by the inner cylinder (20) and the outer cylinder (22).

3. The line connection (10) in accordance with claim 1, characterized in that one of the cylinders (20, 22) is fixed in place.

4. The line connection (10) in accordance with claim 3, characterized in that the cylinder (20) is the cylinder fixed in place.

5. The line connection (10) in accordance with claim 1, characterized in that in the zero position the connections (18.1, 18.2) are spaced by more than 90° from the planet wheel (24).

6. The line connection (10) in accordance with claim 1, characterized in that in the zero position the planet wheel (24) is disposed diametrically in respect to the connections (19.1, 19.2) which are not spaced apart.

7. The line connection (10) in accordance with claim 1, characterized in that guide grooves and/or guide ribs, extending in the circumferential direction, for the intermediate line (12.1) and the additional intermediate line (12.2) are provided on the outer circumferential face of the planet wheel (24), the outer circumferential face of the inner cylinder (20) and on the inner circumferential face of the outer cylinder (22).

8. The line connection (10) in accordance with claim 1, characterized in that the cylinders (20, 22) can be rotated by more than 180° in relation to each other in both directions of rotation out of the zero position into the extreme positions.

9. The line connection (10) in accordance with claim 1, characterized in that detents (30.1, 30.2, 32, 34) are provided on the cylinders (20, 22) for fixation of the extreme positions.

10. The line connection (10) in accordance with claim 8, characterized in that for fixation of extreme positions, in which the cylinders (20, 22) can be rotated in relation to each other out of the zero position at an angle exceeding 180°, two fixed detents (30.1, 30.2) are provided on one cylinder (22), and a pivotable detent lever (32) is provided centered between the fixed detents (30.1, 30.2), wherein the angular distance of the fixed detents (30.1, 30.2) corresponds to the total angle of rotation exceeding 360°, and that a radially oriented detent element (34), which is intended for cooperation with the detent lever (32) in the extreme positions, is fixedly mounted on the other cylinder (20), wherein in the one extreme position the detent lever (32) is located between the one fixed detent (30.1) and the one face of the detent element (34), and in the other extreme position between the other fixed detent (30.2) and the other face of the detent element (34).

11. The line connection (10) in accordance with claim 10, characterized in that the lines (14.1, 16.1) and the branch lines (14.2, 16.2) are electrical lines, wherein the intermediate line (12.1) and the additional intermediate line (12.2) are ribbon cables or print flex.

12. The line connection (10) in accordance with claim 9, characterized in that the lines (14.1, 16.1) and the branch lines (14.2, 16.2) are electrical lines, wherein the intermediate line (12.1) and the additional intermediate line (12.2) are ribbon cables or print flex.

13. The line connection (10) in accordance with claim 8, characterized in that the lines (14.1, 16.1) and the branch lines (14.2, 16.2) are electrical lines, wherein the intermediate line (12.1) and the additional intermediate line (12.2) are ribbon cables or print flex.

14. The line connection (10) in accordance with claim 7, characterized in that the lines (14.1, 16.1) and the branch lines (14.2, 16.2) are electrical lines, wherein the intermediate line (12.1) and the additional intermediate line (12.2) are ribbon cables or print flex.

15. The line connection (10) in accordance with claim 6, characterized in that the lines (14.1, 16.1) and the branch lines (14.2, 16.2) are electrical lines, wherein the intermediate line (12.1) and the additional intermediate line (12.2) are ribbon cables or print flex.

16. The line connection (10) in accordance with claim 5, characterized in that the lines (14.1, 16.1) and the branch lines (14.2, 16.2) are electrical lines, wherein the intermediate line (12.1) and the additional intermediate line (12.2) are ribbon cables or print flex.

17. The line connection (10) in accordance with claim 4, characterized in that the lines (14.1, 16.1) and the branch lines (14.2, 16.2) are electrical lines, wherein the intermediate line (12.1) and the additional intermediate line (12.2) are ribbon cables or print flex.

18. The line connection (10) in accordance with claim 3, characterized in that the lines (14.1, 16.1) and the branch lines (14.2, 16.2) are electrical lines, wherein the intermediate line (12.1) and the additional intermediate line (12.2) are ribbon cables or print flex.

19. The line connection (10) in accordance with claim 2, characterized in that the lines (14.1, 16.1) and the branch lines (14.2, 16.2) are electrical lines, wherein the intermediate line (12.1) and the additional intermediate line (12.2) are ribbon cables or print flex.

* * * * *